US006732380B1

(12) United States Patent
Lee

(10) Patent No.: US 6,732,380 B1
(45) Date of Patent: May 11, 2004

(54) FIXING DEVICE FOR THE WINDSHIELD OF A SAFETY HELMET

(75) Inventor: Te Long Lee, Yung-Kang (TW)

(73) Assignee: Long Huei Helmet Co., Tainan Hsien (TW)

( * ) Notice: Subject to any disclaimer, the term of this patent is extended or adjusted under 35 U.S.C. 154(b) by 0 days.

(21) Appl. No.: 10/373,743

(22) Filed: Feb. 27, 2003

(51) Int. Cl.[7] ..... A42B 1/08
(52) U.S. Cl. ..... 2/424
(58) Field of Search ..... 2/424, 425, 422, 2/9, 10

(56) References Cited

U.S. PATENT DOCUMENTS 5,062,162 A * 11/1991 Kamata ..... 2/424
6,557,185 B1 * 5/2003 Lee ..... 2/424
6,654,969 B2 * 12/2003 Taniuchi ..... 2/424

FOREIGN PATENT DOCUMENTS

JP 04185704 A * 7/1992 ..... A42B/3/22

* cited by examiner

*Primary Examiner*—Rodney M. Lindsey
(74) *Attorney, Agent, or Firm*—Bacon & Thomas PLLC

(57) ABSTRACT

A fixing device for the windshield of a safety helmet includes a windshield having its left and right end provided with a projection with projecting wings, a projecting rib and a slide block. A helmet shell is fixed with a base plate respectively at the opposite ends of its window. Each base plate is provided with a corrugated edge near the annular recess base, and a slide groove for receiving the slide block with a slidable lip block in its intermediate portion of a groove. In assembling, the windshield is slightly moved for a little angle, with projecting wings of the projection fitting in the two notches of the helmet shell and fixed by the lip blocks to keep the windshield immovable in place, convenient to assemble and use the windshield with the helmet shell.

3 Claims, 14 Drawing Sheets

(C–C)

(B–B)

(A–A)

FIXING DEVICE FOR THE WINDSHIELD OF A SAFETY HELMET

BACKGROUND OF THE INVENTION

This invention relates to a fixing device for the wind shield of a safety helmet, particularly to one possible to have a windshield assembled on the helmet shell conveniently without depending on any assembly tool or bolt, able to assemble and disassemble the windshield on and from the helmet shell with quickness.

A case pertaining to a fixing device for the windshield of a safety helmet had been applied for a patent to the US Patent Office by the inventor of this invention on Oct. 22, in 2001 and acquired a patent Ser. No. 10/014,272. This invention is newly researched and developed to improve the previous one.

SUMMARY OF THE INVENTION

The objective of the invention is to offer a fixing device for the windshield of a safety helmet, able to have a windshield assembled on and disassembled from a safety helmet and conveniently and quickly, needless to depend on any assembly tool.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
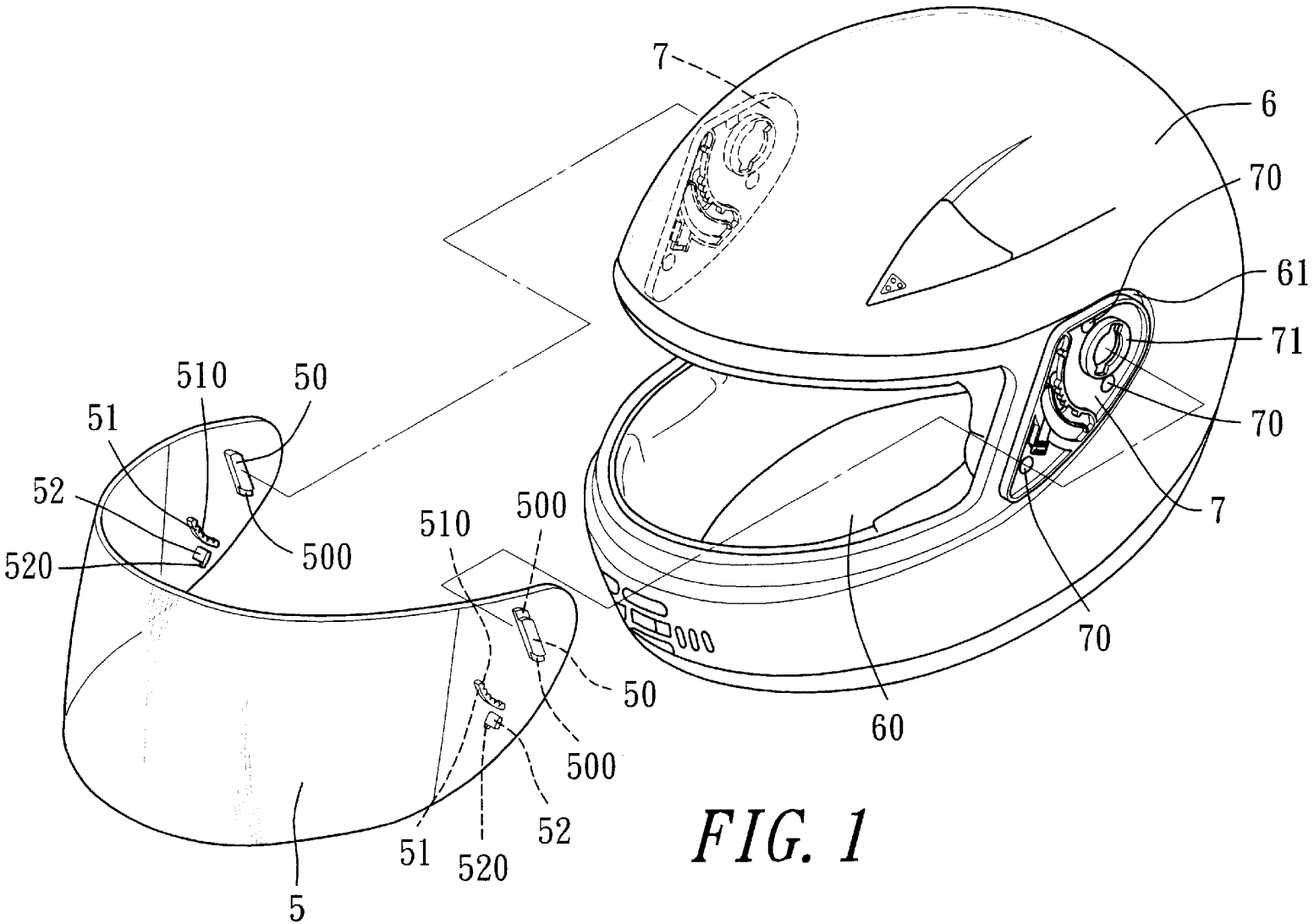
FIG. 1 is an exploded perspective view of a fixing device for the windshield of a safety helmet in the present invention.

A preferred embodiment of a fixing device for the windshield of a safety helmet in the present invention, as shown in FIG. 1, includes a windshield 5 and a helmet shell 6 having an arc-shaped window 60 at the front side.

The windshield 5 has the same shape as the window 60 of the helmet shell 6 for closing up the viewing window 60. The windshield 5 has the inner wall of its opposite ends respectively facing the extending wall of the left and the right end of the window 60 of helmet shell 6 and provided with a short T-shaped projection 50 having projecting wings 500 extending outward from the opposite ends. An arc-shaped projecting rib 51 having a corrugated rib edge 510 facing the projection 50 is provided under the projection 50, and a slide block 52 having a slide arm 520 extending downward is positioned under the projecting rib 51.

Figure 2:
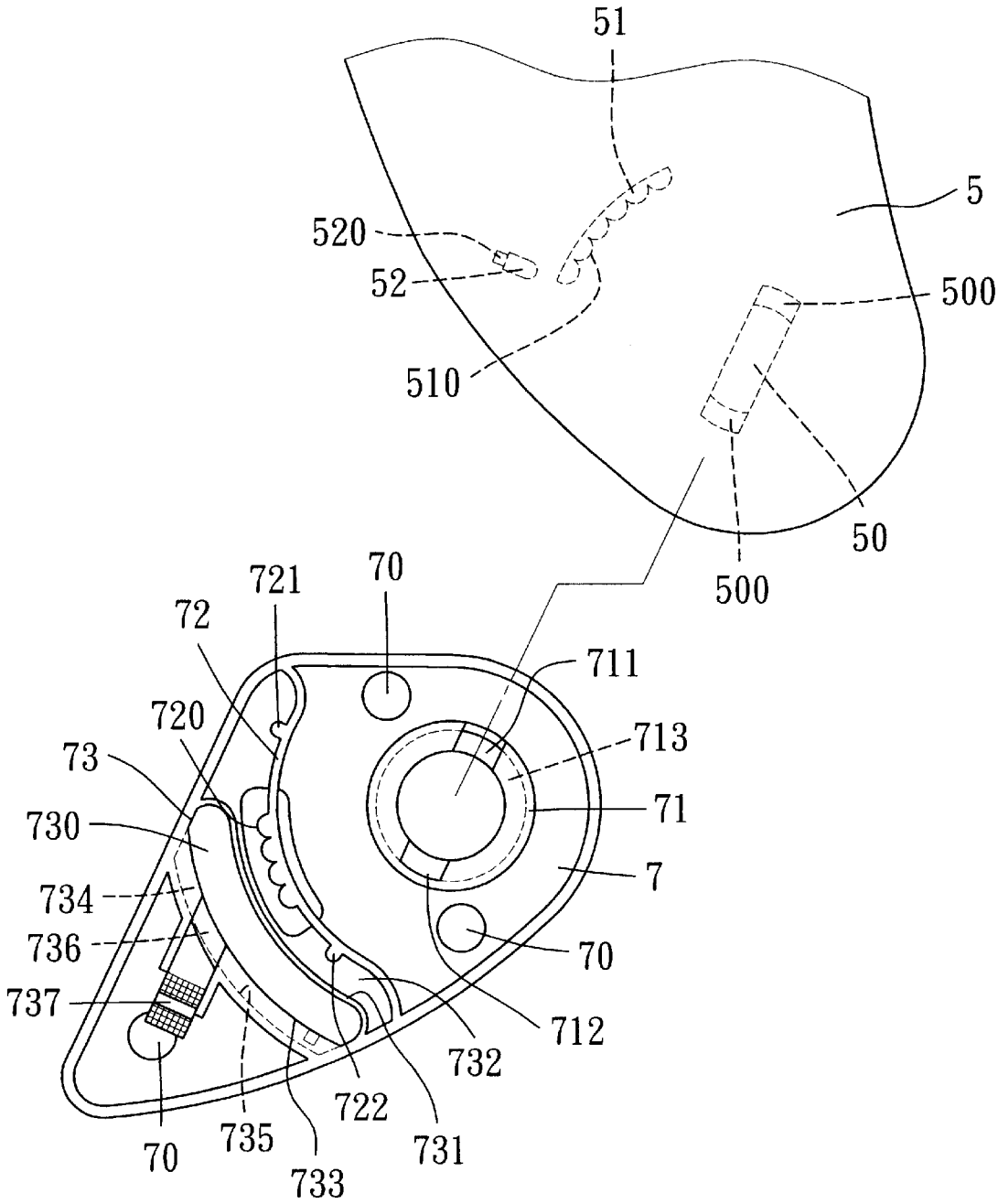
FIG. 2 an exploded perspective view of the fixing device for the windshield of a safety helmet in the present invention, indicating that the windshield is to be assembled on the safety helmet.
Figure 7:
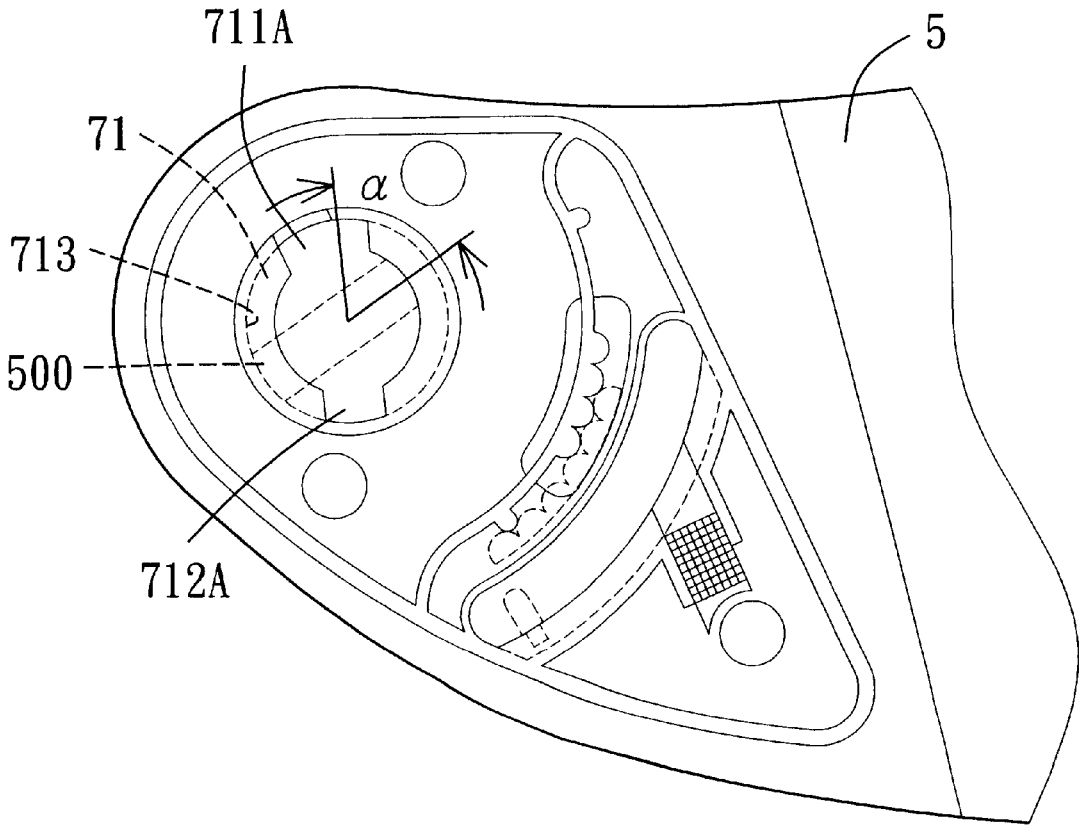
FIG. 7 is a cross-sectional view of the fixing device for the windshield of a safety helmet in the present invention, indicating a fourth condition that the wind shield is assembled on the safety helmet.

The helmet shell 6 is formed with an arc-shaped window 60 at the front side, and the extending wall of the left and the right end of the window 60 is respectively formed with a recessed surface 61 having a base plate 7 riveted thereon for receiving the two projections 50, the two projecting ribs 51 and the two slide blocks 52 of the wind shield 5. Each base plate 7 is provided with an annular recess base 71 matching with the projection 50 of the windshield 5, as shown in FIG. 2. The annular recess base 71 has an upper and a lower notch 711, 712 bored correspondingly at its annular wall surface 710, and the two notches 711, 712 are formed with an annular groove 713 along the lower side of the annular wall surface 710 of the annular recess base 71. The two base plates 7 fixed on the left and the right side of the helmet shell 6 are not completely symmetrical, that is, the opening of the upper and the lower notch 711A, 712A of the left base plate 7 has a wide upper portion and a narrow lower portion, as shown in FIG. 7, and the projection 50 of the left end of the wind-shield 5 only has its lower end formed with the projection wing 500 to be fitted in the lower notch 712A.

In addition, each base plate 7 is provided with an arc-shaped wall 72 near the annular recess base 71 to match with the projection rib 51 of the windshield 5. The projecting wall 72 has a short corrugated projecting edge 720 formed on the front edge and two stop members 721, 722 respectively positioned at an upper and a lower wall surface on which the corrugated projecting edge 720 lies. The base plate 7 further has a slide base 73 provided under the projecting wall 72 and having a slide groove 730 for receiving the slide block 52 of the windshield 5, with a position-limiting space 732 formed between the groove wall 731 of the slide groove 730 and the projecting wall 72. Besides, the groove wall 733 of the slide groove 730 has its upper side provided with a lip edge 734 extending toward the slide groove 730 to form a recessed lip groove 735 in one side wall, and the lip groove 735 has its intermediate portion formed with a side lip opening 736 for receiving a slidable lip block 737 therein.

Figure 3:
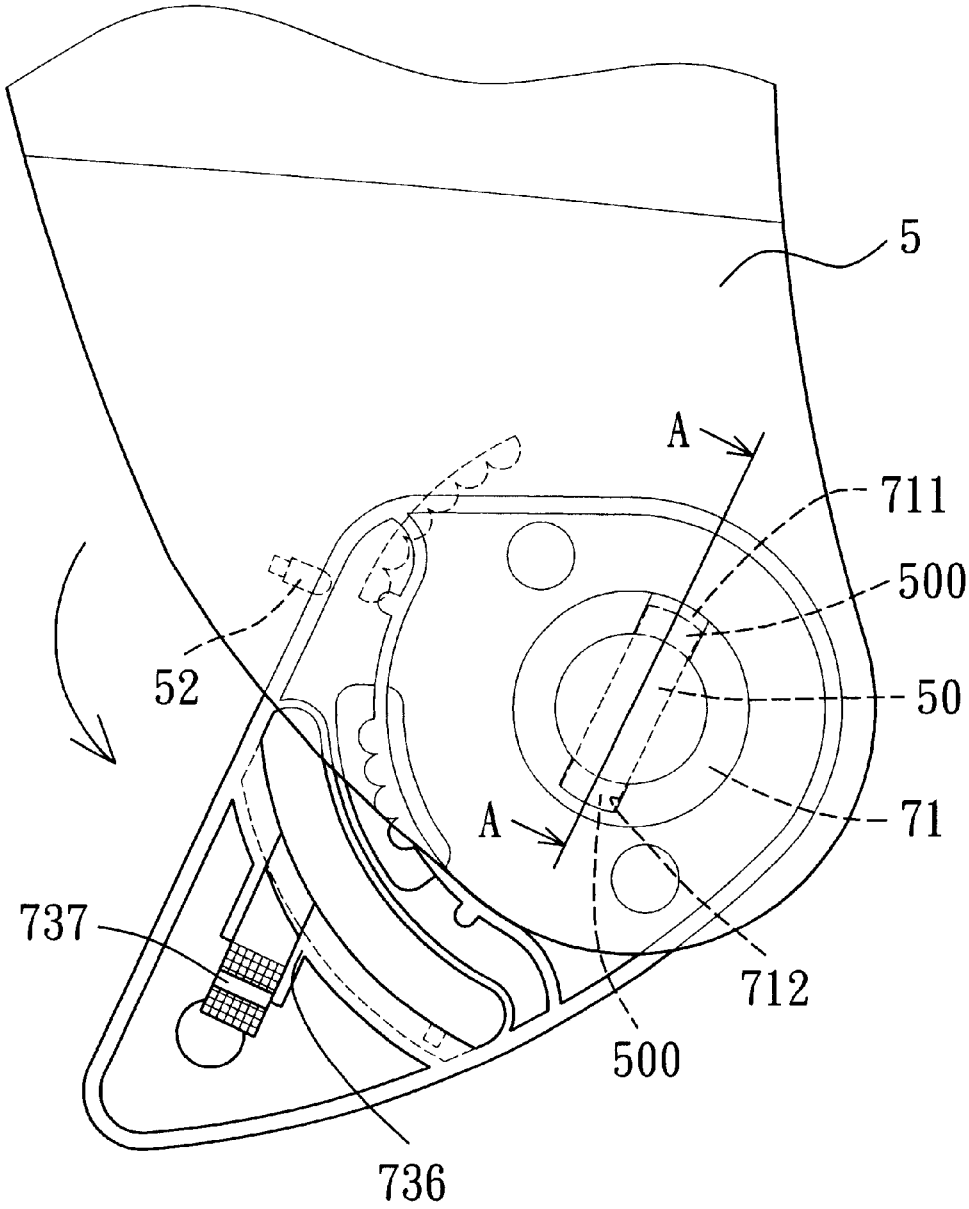
FIG. 3 is a cross-sectional view of the fixing device for the windshield of a safety helmet in the present invention, indicating a first condition that the windshield is assembled on the safety helmet.
Figure 5:
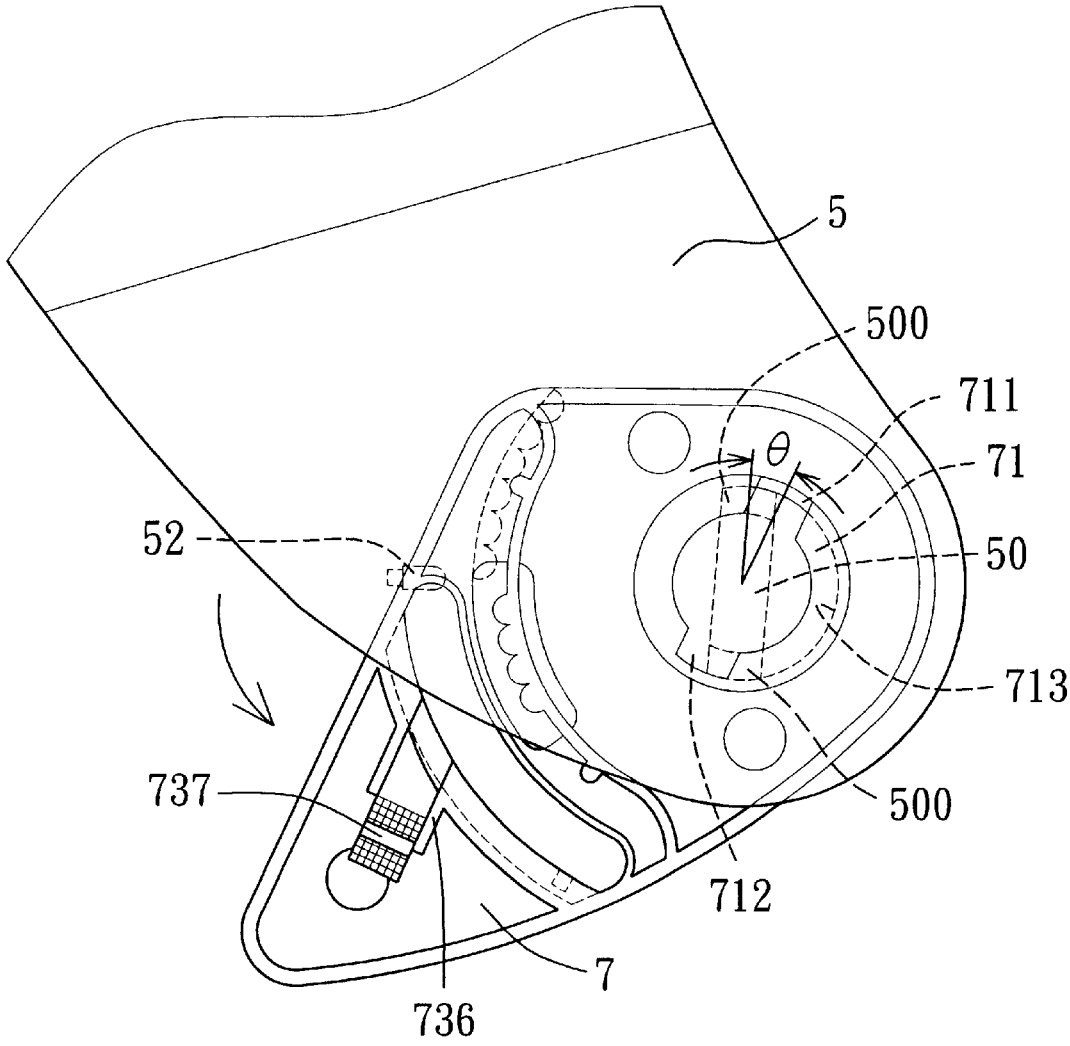
FIG. 5 is a cross-sectional view of the fixing device for the windshield of a safety helmet in the present invention, indicating a second condition that the windshield is assembled on the safety helmet.
Figure 6:
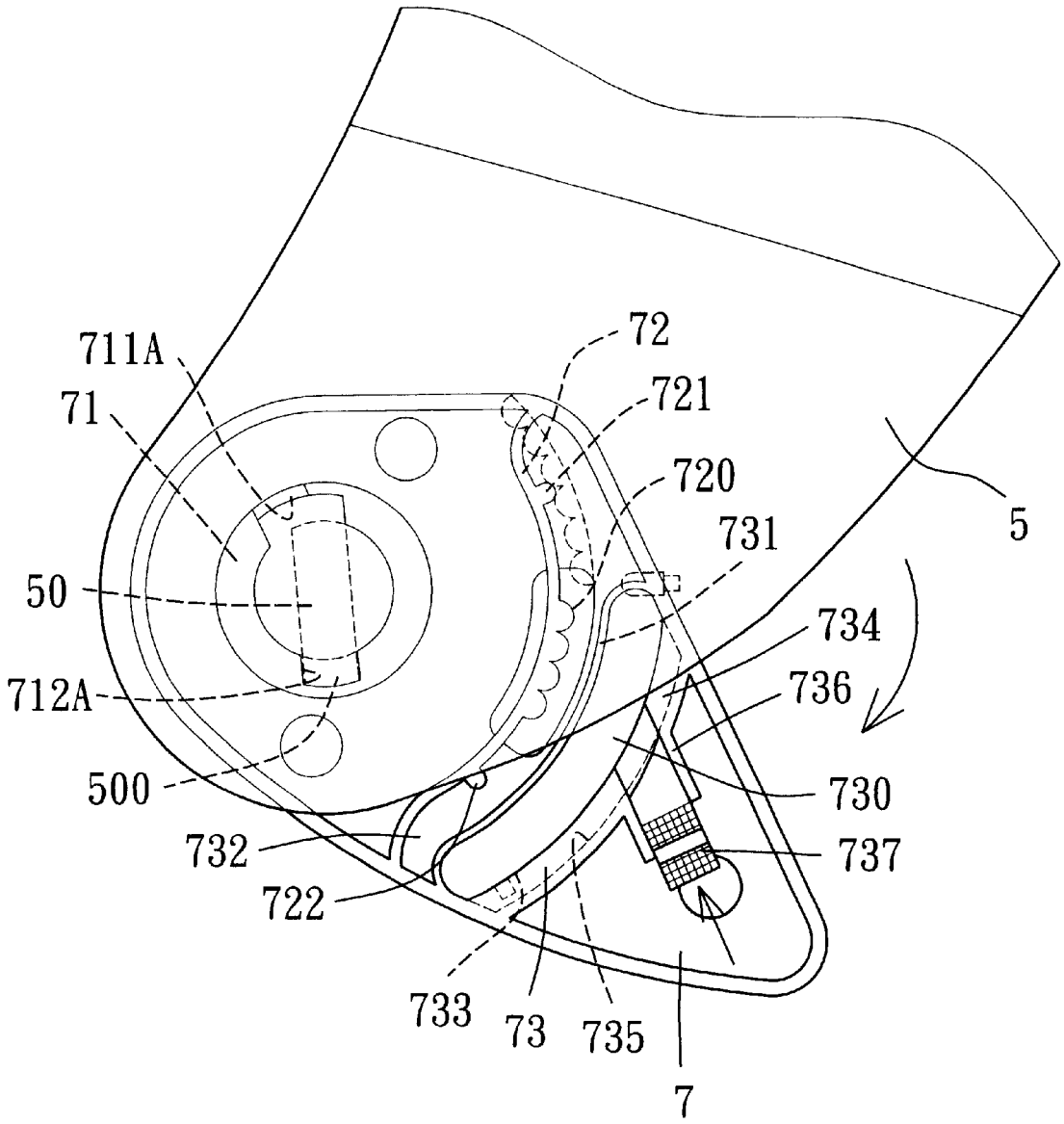
FIG. 6 is a cross-sectional view of the fixing device for the windshield of a safety helmet in the present invention, indicating a third condition that the wind shield is assembled on the safety helmet.

To assemble the windshield 5 on the helmet shell 6, as shown in FIGS. 1 and 2, firstly, the windshield 5 has the projecting wings 500 of its right T-shaped projection 50 respectively positioned in the two notches 711, 712 of the annular recess bass 71 of the helmet shell 6, as shown in FIG. 3. Then, the windshield 5 is slightly turned for a θ angle, as shown in FIG. 5, letting the two projecting wings 500 fitted in the annular groove 713 and the right end of the wind shield 5 fixed in the right annular recess base 71 of the helmet shell 6. Subsequently, the lip block 737 of the base plate 7 on the opposite sides of the helmet shell 6 is moved downward to let the lip opening 736 exposed for the slide block 52 of the windshield 5 to be moved in. In the same way, the windshield 5 has the bottom wing 500 of its left T-shaped projection 50 positioned in the lower notch 712A of the annular recess base 71 of the left side of the helmet shell 6, as shown in FIG. 6. Although the windshield 5 previously has its right end turned for a θ angle, the bottom wing 500 of its left T-shaped projection 50 still can be exactly fitted in the lower notch 712A of the helmet shell 6, because the upper portion of the opening of the upper notch 711A is larger than the lower portion. Then, the windshield 5 is turned for a α angle, as shown in FIG. 7, letting the projecting wing 500 moved and fitted in the annular groove 713 of the annular recess base 71. Thus, the windshield 5 can be easily assembled on the helmet shell 6 when it is turned upward.

Figure 8:
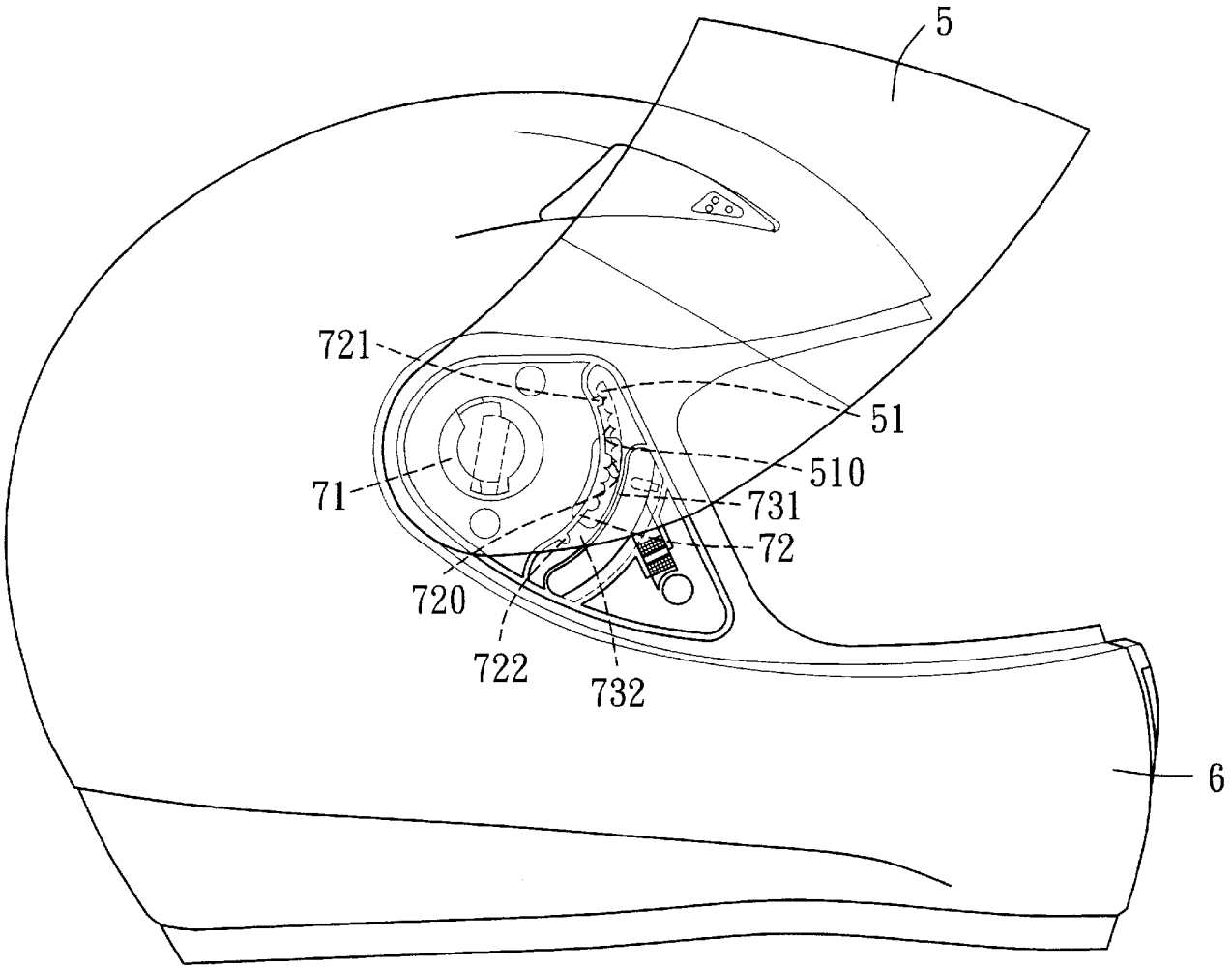
FIG. 8 is a cross-sectional view of the fixing device for the windshield of a safety helmet in the present invention, indicating that the windshield is assembled on the safety helmet and pushed open.
Figure 9:
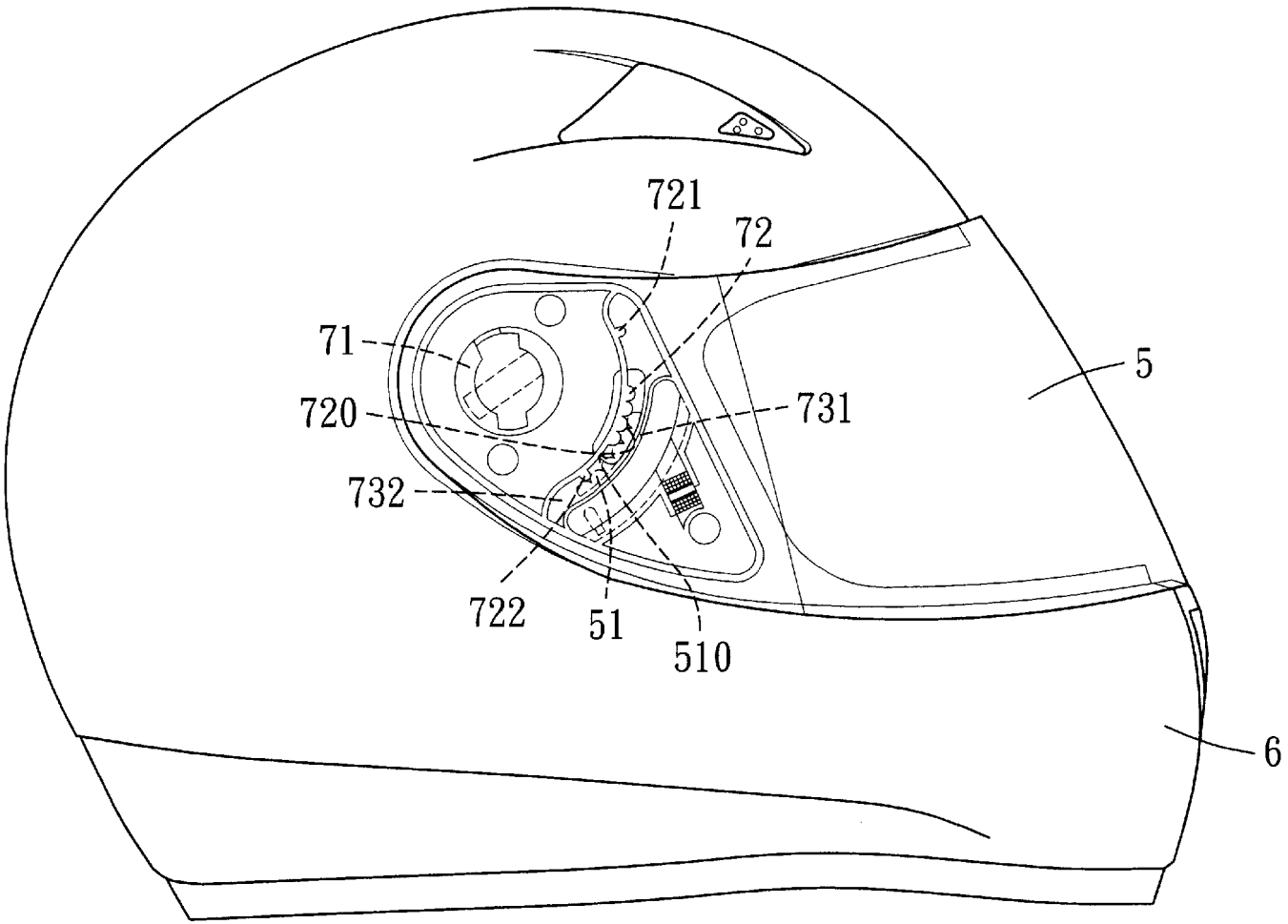
FIG. 9 is a cross-sectional view of the fixing device for the windshield of a safety helmet in the present invention, indicating that the windshield is assembled on the safety helmet and closed for use.

In using, as shown in FIGS. 8 and 9, the windshield 5 has its left and right end respectively assembled with the two annular recess bases 71 of the helmet shell 6, which has the same function of a bearing base, therefore the windshield 5 can be pushed open or closed quite smoothly. Be sides, the projecting rib 51 with its corrugated rib edge 510 provided on the left and the right end of the windshield 5 is positioned in the position-limiting space 732 between the groove wall 731 of the slide groove 730 and the projecting wall 72 of the helmet shell 6 and engaged with the corrugated projecting edge 720 of the projecting wall 72. Thus, after the windshield 5 is pushed open, it can be adjusted and positioned at various angles, and stop members 721, 722 on the projecting wall 72 can stabilize the windshield 5 when it is opened or closed to certain angle.

Figure 14:
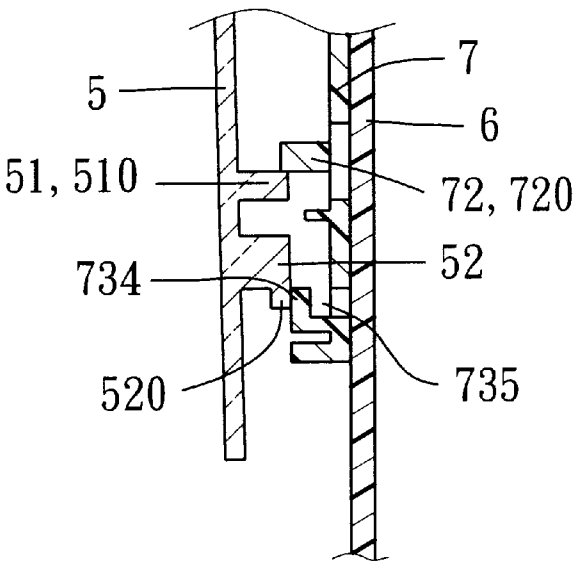
FIG. 14 is a cross-sectional view of the line C—C in FIG. 13.
Figure 11:
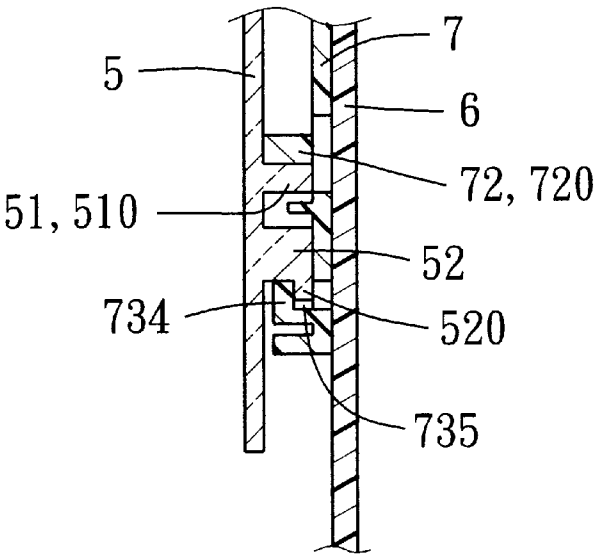
FIG. 11 is a cross-sectional view of the line B—B in FIG. 10.
Figure 4:
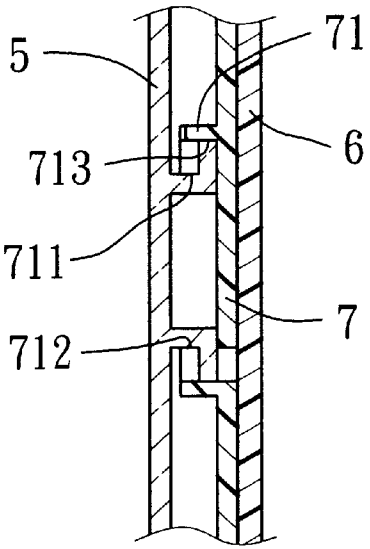
FIG. 4 is a cross-sectional view of the line A—A in FIG. 4.
Figure 10:
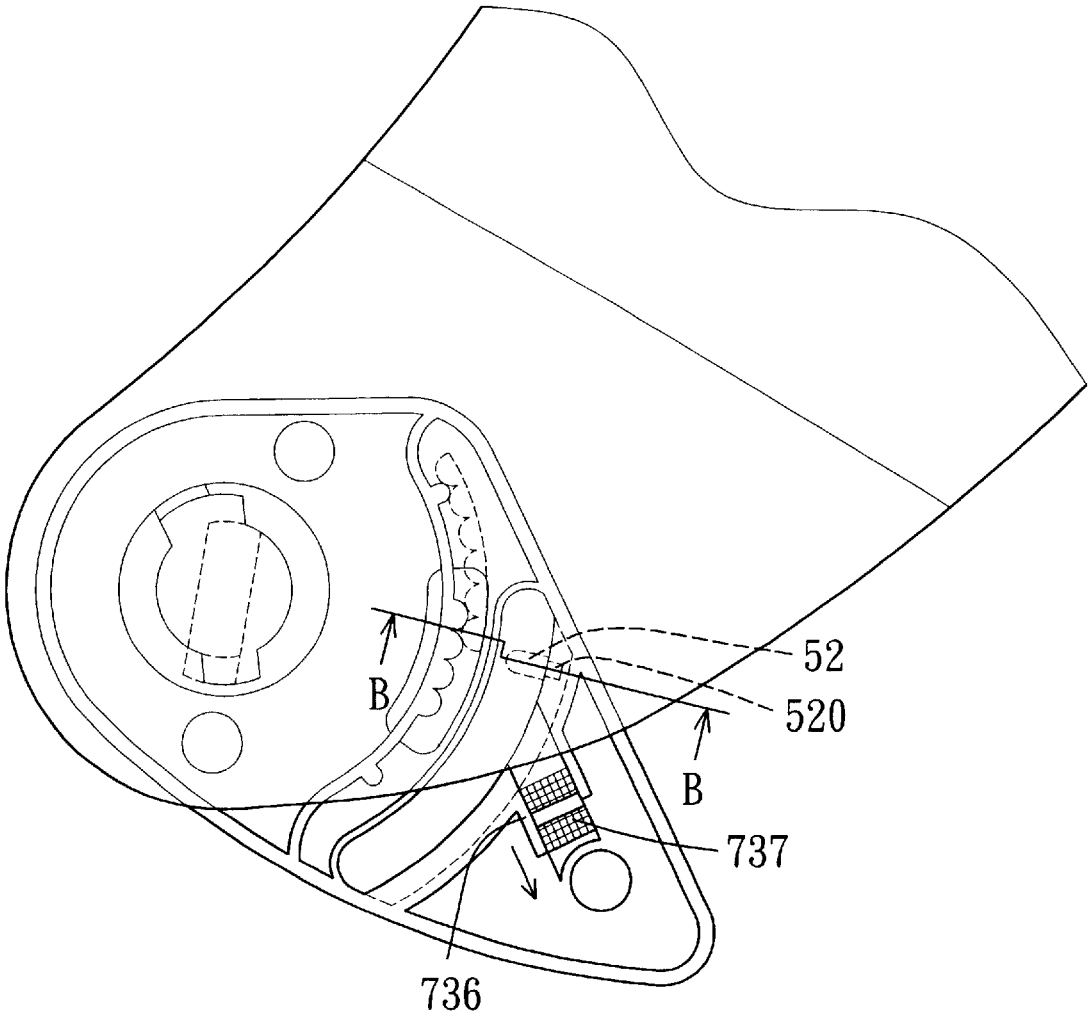
FIG. 10 is a magnified cross-sectional view of the fixing device for the windshield of a safety helmet in the present invention, indicating that the windshield is assembled on the safety helmet and pushed open.
Figure 12:
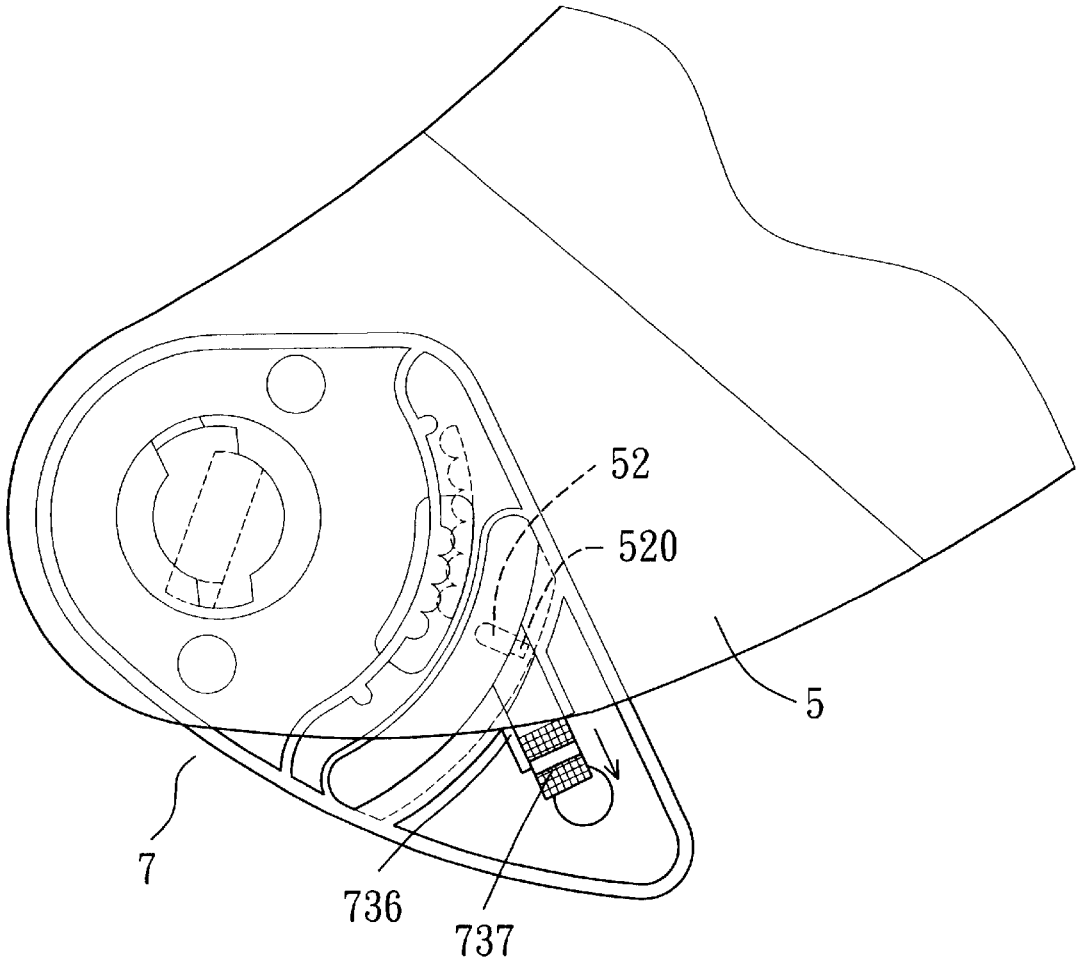
FIG. 12 is a cross-sectional view of the fixing device for the windshield of a safety helmet in the present invention, indicating a first stage of the windshield being disassembled from the safety helmet.
Figure 13:
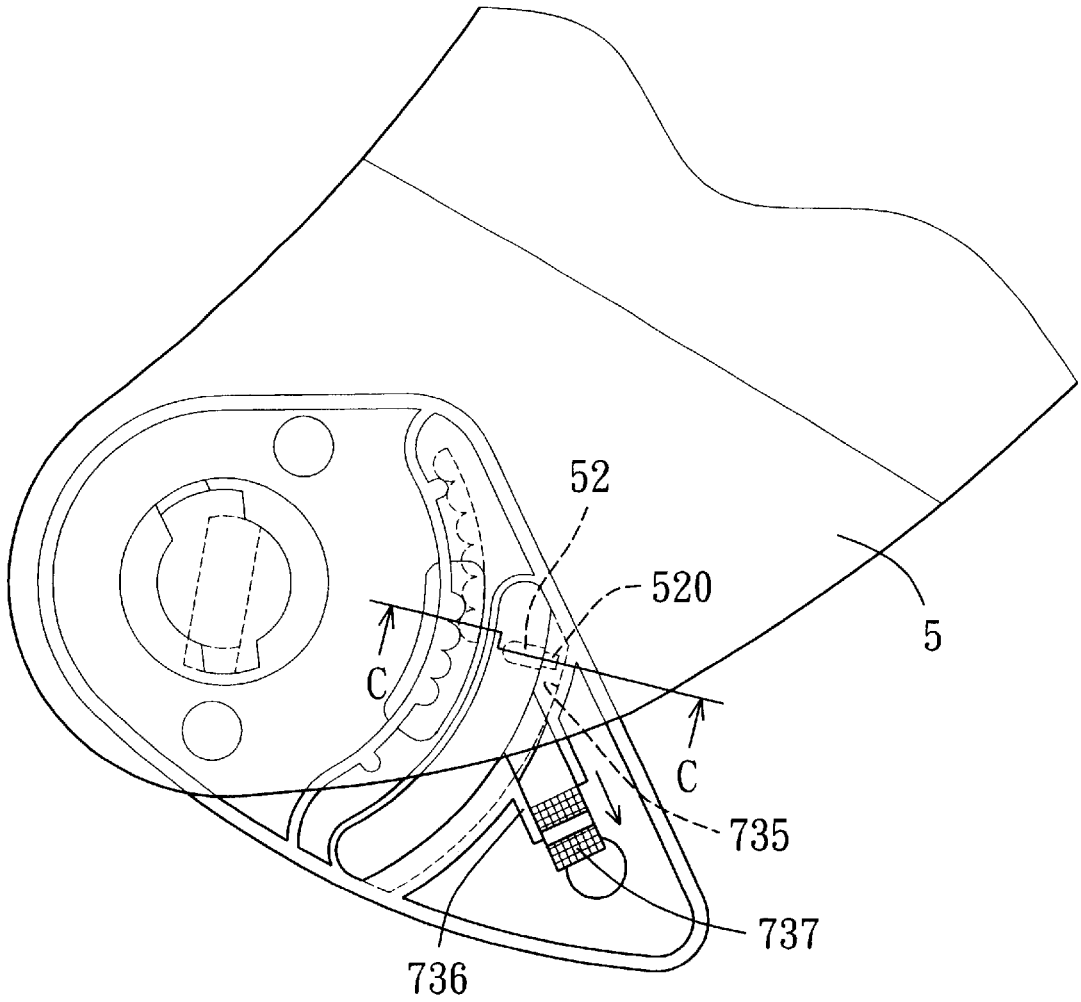
FIG. 13 is a cross-sectional view of the fixing device for the windshield of a safety helmet in the present invention, indicating a second stage of the windshield being disassembled from the safety helmet.
Figure 15:
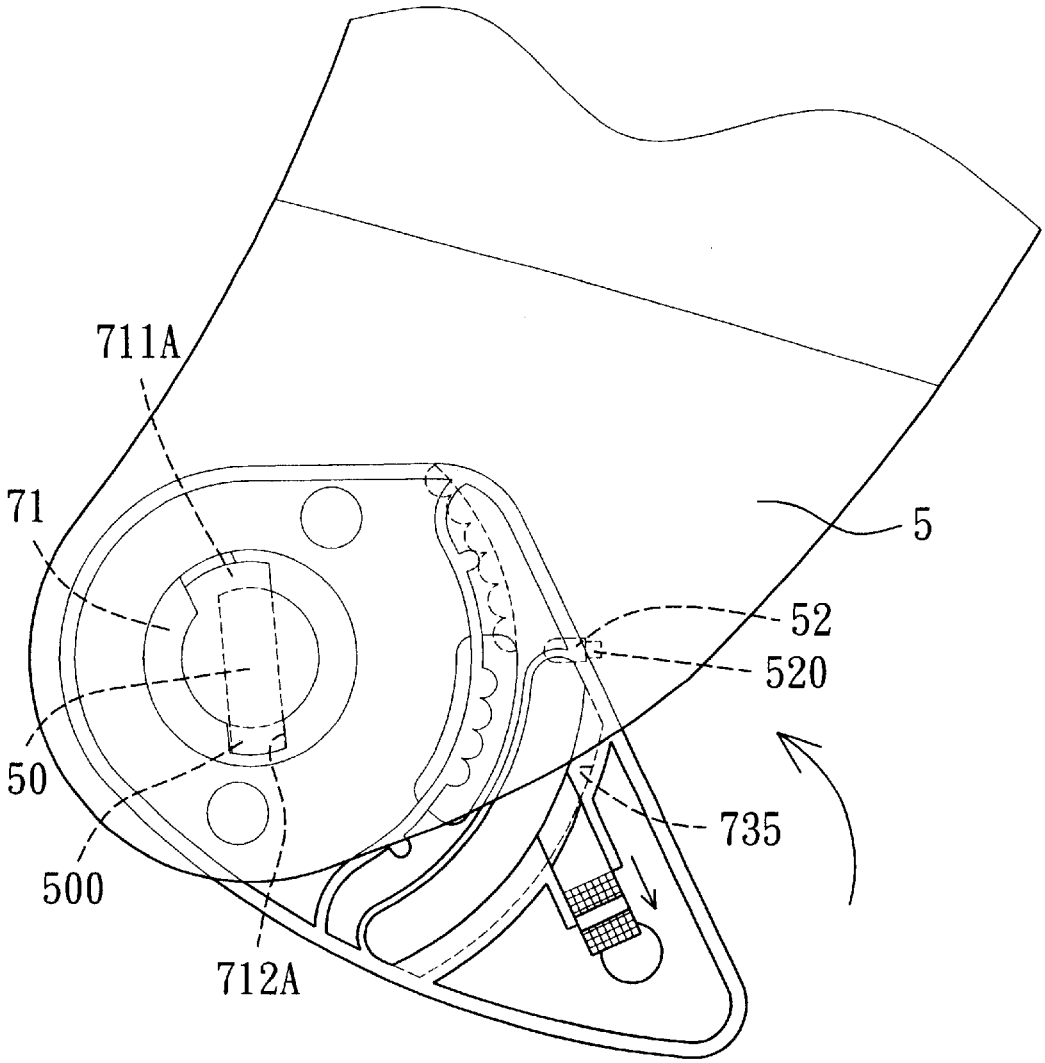
FIG. 15 is a cross-sectional view of the fixing device for the windshield of a safety helmet in the present invention, indicating a third stage of the windshield being disassembled from the safety helmet.
Figure 16:
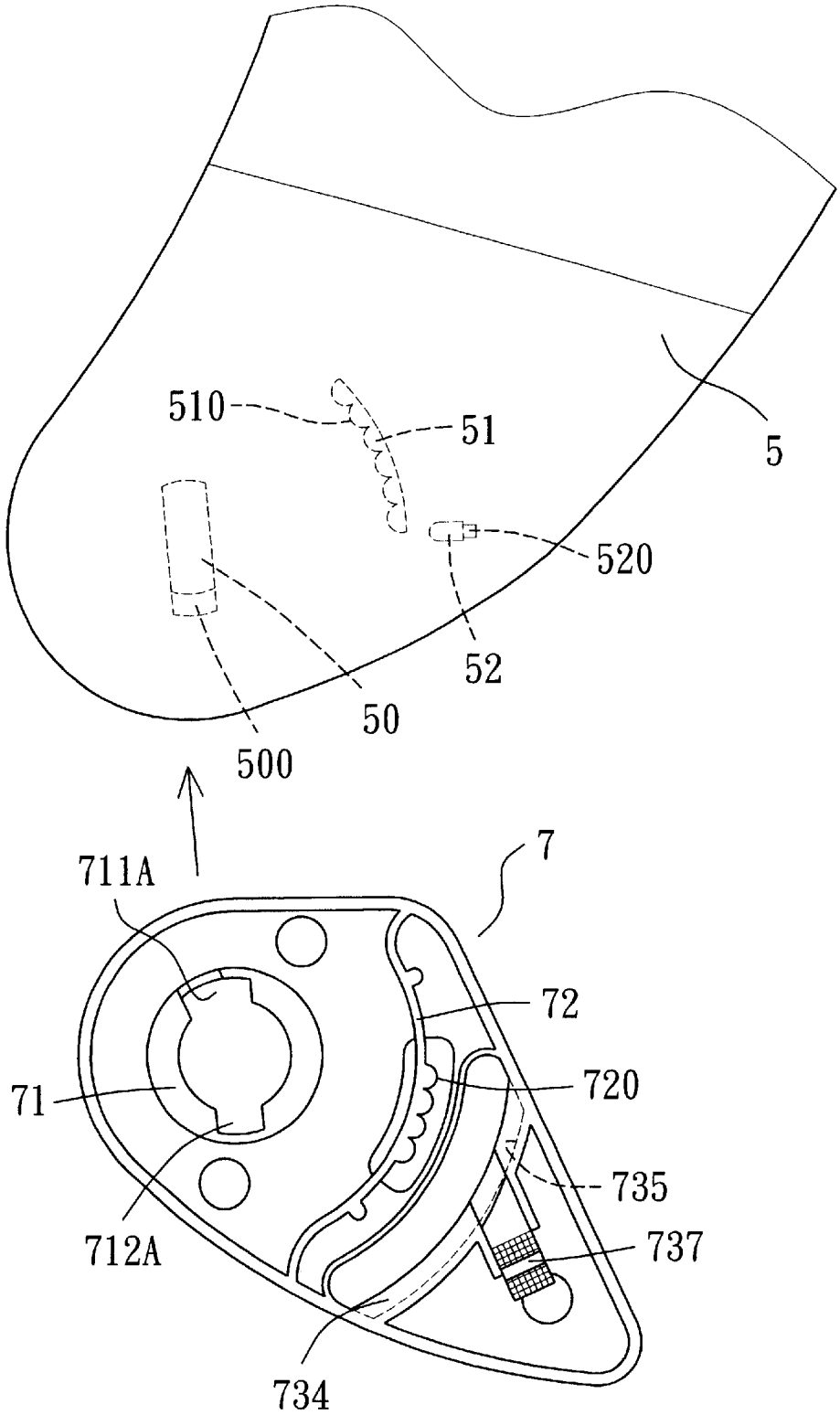
FIG. 16 is a cross-sectional view of the fixing device for the windshield of a safety helmet in the resent invention, indicating the windshield disassembled from the safety helmet.

To disassemble the wind shield 5 from the helmet shell 6, as shown in FIGS. 10 and 11, since the slide arm 520 of the slide block 52 on the opposite ends of the windshield 5 is position limited by the lip groove 735 and the lip edge 734 of the base plate 7, the lip block 737 of the base plate 7 on the opposite ends of the helmet shell 6 has to be moved downward, as shown by the arrow in FIG. 10, to let the lip opening 736 exposed. Next, the windshield 5 is slightly turned for a small angle to let the slide block 52 facing the lip opening 736, as shown in FIG. 12, and then pulled outward to let the slide arm 520 of the slide block 52 disengaged from the lip groove 735, as shown in FIGS. 13, 14 and 15. Then, the windshield 5 is turned upward to enable the projecting wings 500 of the projections 50 disengaged from the notches 711, 712 and 711*a*, 712A of the annular recess bases 71 on the opposite ends of the helmet shell 6, as shown in FIGS. 1 and 16.

To sum up, the windshield 5 in this invention can be assembled on and disassembled from a helmet shell 6 conveniently and quickly without depending on any assembly tool, having great practicability.

While the preferred embodiment of the invention has been described above, it will be recognized and understood that various modifications may be made therein and the appended claims are intended to cover all such modifications that may fall within the spirit and scope of the invention.

I claim:

1. A fixing device for the windshield of a safety helmet comprising:

a windshield having the inner wall of its opposite ends respectively provided with a projection, said projection having projecting wings extending outward, a projecting rib with an upper corrugated edge positioned under said projection, a slide block positioned under said projecting rib:

a helmet shell having an arc-shaped window at a front side, a base plate fixed on the extending wall of the left and the right end of said window, each said base plate provided with an annular recess base, said annular recess base having an upper and a lower notch provided correspondingly in its annular wall surface, said two notches formed with an annular groove along the lower side of said annular wall surface; a projecting wall provided on each said base plate at the left side of said annular recess base and formed with a corrugated edge at a front side, a slide groove formed under said projecting wall for receiving said slide block of said windshield, a position-limiting space formed between said projecting wall and the groove wall of said slide groove; a lip edge extending from the upper end of the other groove wall of said slide groove to form an inner concave lip groove, said lip groove having a side lip opening, said side lip opening receiving a slidable lip block therein: and said windshield having said projecting wings of said projection positioned in said two, notches of said annular recess base, said projecting wings moved and engaged in said annular groove of said annular recess base when said windshield is turned for a small angle, thus said windshield having its end fixed with said annular recess base of said helmet shell, said two lip blocks of said two base plates on the opposite sides of said helmet shell moved downward to let said lip openings exposed, said slide block on the opposite ends of said windshield moved in said lip opening; said windshield having said projecting wing of said projection positioned in said two notches of said annular recess base of said helmet shell, said windshield turned upward slightly and fixed on said helmet shell, said corrugated rib edge of said projecting rib of said windshield and said corrugated projecting edge of projecting wall of said helmet shell contacting with each other in position, the contact of said corrugated rib edge of said projecting rib and said corrugated projecting edge of projecting wall enabling said windshield adjusted and positioned at various angles when it is pushed open; to disassemble said wind shielding lens from said helmet shell said lip blocks of said base plates on the opposite sides of said helmet shell moved downward to let said lip opening exposed, said lip opening facilitating said slide blocks of said windshield to be pulled outward, said windshield pushed upward to let the projecting wings of its projections disengaged from said notches of said annular recess base of said helmet shell.

2. The fixing device for the windshield of a safety helmet as claimed in claim 1, wherein the opening of said two notches of the said left base plate has a wide upper portion and a narrow lower portion.

3. The fixing device for the windshield of a safety helmet as claimed in claim 1, wherein said projecting wall of said helmet shell has two stop members respectively provided on the upper and the lower portion of the wall surface on which said projecting edge lies.

* * * * *